US009812063B2

(12) United States Patent
Lee et al.

(10) Patent No.: US 9,812,063 B2
(45) Date of Patent: Nov. 7, 2017

(54) DISPLAY APPARATUS, METHOD AND APPARATUS FOR CONTROLLING THE SAME

(71) Applicant: SAMSUNG DISPLAY CO., LTD., Yongin, Gyeonggi-Do (KR)

(72) Inventors: Dongwon Lee, Yongin (KR); Heechul Hwang, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 131 days.

(21) Appl. No.: 14/732,584

(22) Filed: Jun. 5, 2015

(65) Prior Publication Data

US 2016/0133193 A1 May 12, 2016

(30) Foreign Application Priority Data

Nov. 10, 2014 (KR) ..... 10-2014-0155523

(51) Int. Cl.
*G09G 3/32* (2016.01)
*G09G 3/3275* (2016.01)
*G09G 3/3225* (2016.01)

(52) U.S. Cl.
CPC ..... *G09G 3/3275* (2013.01); *G09G 3/3225* (2013.01); *G09G 2320/029* (2013.01);
(Continued)

(58) Field of Classification Search
CPC ..... G09G 3/3275; G09G 2320/045; G09G 2360/16; G09G 2320/0295; G09G 2320/0242; G09G 2320/0233; G09G 3/3241; G09G 3/3233; G09G 3/3688; G09G 3/3225; G09G 2320/029; G06F 3/0412
See application file for complete search history.

(56) References Cited

U.S. PATENT DOCUMENTS 5,032,899 A 7/1991 Sato
2003/0063053 A1* 4/2003 Yamazaki ..... G09G 3/3241 345/82
(Continued)

FOREIGN PATENT DOCUMENTS

KR 1990-0002655 A 2/1990
KR 10-2009-0079955 A 7/2009
(Continued)

*Primary Examiner* — Nicholas Lee
*Assistant Examiner* — Richard Hong
(74) *Attorney, Agent, or Firm* — Lewis Roca Rothgerber Christie LLP

(57) ABSTRACT

A display control method of controlling a display operation of a display panel which includes a plurality of pixels arranged in a column direction and a row direction. A plurality of pixels include a plurality of sensing pixels, of which electrical values are sensed, and a non-sensing pixel that is not a sensing pixel. The display control method includes accumulating image data values respectively input to the plurality of pixels to obtain deterioration information for each pixel, obtaining an electrical value of each of the plurality of sensing pixels, determining an electrical value of the non-sensing pixel, based on the deterioration information and an electrical value of each sensing pixel, and controlling the display operation of the display panel, based on electrical values of the plurality of pixels.

19 Claims, 7 Drawing Sheets

(52) U.S. Cl.
CPC ..... *G09G 2320/0233* (2013.01); *G09G 2320/043* (2013.01); *G09G 2320/045* (2013.01); *G09G 2360/16* (2013.01)

(56) References Cited

U.S. PATENT DOCUMENTS

| | | | | |
|---|---|---|---|---|
| 2008/0192018 | A1* | 8/2008 | Park | G06F 3/0412 345/173 |
| 2010/0033623 | A1 | 2/2010 | Arimoto | |
| 2010/0045709 | A1* | 2/2010 | Nakamura | G09G 3/3233 345/690 |
| 2010/0253707 | A1* | 10/2010 | Miyake | G09G 3/3233 345/690 |
| 2011/0279436 | A1* | 11/2011 | Komiya | G09G 3/3233 345/212 |
| 2012/0212516 | A1 | 8/2012 | Ahn et al. | |
| 2016/0293123 | A1* | 10/2016 | Feng | G09G 3/3688 |

FOREIGN PATENT DOCUMENTS

| | | | |
|---|---|---|---|
| KR | 10-2011-0076652 | A | 7/2011 |
| KR | 10-2012-0094736 | A | 8/2012 |
| KR | 10-2014-0083184 | A | 7/2014 |

* cited by examiner

DISPLAY APPARATUS, METHOD AND APPARATUS FOR CONTROLLING THE SAME

CROSS-REFERENCE TO RELATED APPLICATION

This application claims priority to and the benefit of Korean Patent Application No. 10-2014-0155523, filed on Nov. 10, 2014, in the Korean Intellectual Property Office, the disclosure of which is incorporated herein in its entirety by reference.

BACKGROUND

1. Field

One or more exemplary embodiments relate to a display apparatus and a method and apparatus for controlling the same.

2. Description of the Related Art

Recently, flat panel display apparatuses having a reduced weight and volume in comparison to a cathode ray tube (CRT) are being developed. Examples of flat panel display apparatuses include liquid crystal display (LCD) apparatuses, field emission display (FED) apparatuses, plasma display panels (PDPs), and organic light-emitting display apparatuses.

As a type of flat panel display apparatus, the organic light-emitting display apparatuses use an organic compound as a light-emitting material, and display an image by using organic light-emitting diodes (OLEDs) that emit light by recombining electrons with holes.

The organic light-emitting display apparatuses have a fast response time and are driven at low power consumption. Also, the organic light-emitting display apparatuses have good luminance and color purity, and are thin and light-weight. Therefore, it is expected that an organic light-emitting display apparatus may be usefully applied to various display apparatuses in addition to portable display apparatuses.

The organic light-emitting display apparatuses include a plurality of pixels, and emit light at luminance corresponding to a data voltage applied to each of the plurality of pixels.

Each of the plurality of pixels includes an OLED and a pixel circuit that is connected to a data line and a scan line to control the OLED. The OLED emits light at luminance corresponding to a driving current supplied from the pixel circuit.

The pixel circuit may include a plurality of transistors and a storage capacitor. When a scan signal is supplied to the scan line, the pixel circuit controls the driving current supplied to the OLED in response to a data signal supplied to the data line.

Since efficiency changes over time due to deterioration of the OLED, each pixel of the organic light-emitting display apparatus may lose the ability to display an image having desired luminance. The OLED is actually deteriorated with time, and for this reason, light having low luminance is generated in response to the same data signal.

SUMMARY

One or more exemplary embodiments include a display apparatus and a method and apparatus for controlling the same.

Additional aspects will be set forth in part in the description which follows and, in part, will be apparent from the description, or may be learned by practice of the presented embodiments.

According to one or more exemplary embodiments, a display control method of controlling a display operation of a display panel which includes a plurality of pixels arranged in a column direction and a row direction, includes: accumulating image data values respectively input to the plurality of pixels to obtain deterioration information for each of the plurality of pixels; obtaining an electrical value of each of a plurality of sensing pixels; determining an electrical value of a non-sensing pixel, based on the deterioration information of each of the plurality of pixels and the electrical value of each of the plurality of sensing pixels; and controlling the display operation of the display panel, based on electrical values of the plurality of pixels, wherein the plurality of pixels includes the plurality of sensing pixels, of which electrical values are sensed, and the non-sensing pixel, which is different from a sensing pixel.

In one embodiment, the determining includes determining the electrical value of the non-sensing pixel as an electrical value of one of the sensing pixels, wherein the one sensing pixel has the same deterioration information as the non-sensing pixel.

In one embodiment, the electrical value of each of the sensing pixels is sensed via a corresponding one of a plurality of sensing lines which are in the display panel, and each of the plurality of sensing lines is in correspondence with at least one pixel column.

In one embodiment, the determining includes determining the electrical value of the non-sensing pixel, to be same as the electrical value of one of the sensing pixels, wherein said one sensing pixel has the same deterioration information as the non-sensing pixel, and said one sensing pixel is located in the same column as the non-sensing pixel.

In one embodiment, electrical values of a plurality of sensing pixels located in a first pixel column and a second pixel column adjacent to the first pixel column are sensed via the same sensing line, and the determining includes determining the electrical value of the non-sensing pixel located in the first pixel column or the second pixel column, to be same as the electrical value of one of the sensing pixels, wherein said one sensing pixel has the same deterioration information as the non-sensing pixel, and said one sensing pixel is located in the first pixel column or the second pixel column.

In one embodiment, a sensing pixel of the first pixel column and a sensing pixel of the second pixel column are in different pixel rows.

In one embodiment, each of the plurality of sensing lines is in correspondence with a plurality of pixel columns, and in a plurality of pixel columns corresponding to one of the plurality of sensing lines, only one sensing pixel is located in each pixel row.

In one embodiment, the determining includes: estimating a correlation between the electrical values of the plurality of sensing pixels and deterioration information of the plurality of sensing pixels; and determining the electrical value of the non-sensing pixel, based on deterioration information of the non-sensing pixel and the estimated correlation.

In one embodiment, the electrical values of the plurality of sensing pixels are sensed by a plurality of sensing lines which are in the display panel, each of the plurality of sensing lines is in correspondence with at least one pixel column, and the determining includes: estimating a correlation between the deterioration information of the sensing pixels and the electrical values of the sensing pixels, wherein the correlation corresponds to each of the sensing lines, the electrical values of the sensing pixels are measured by utilizing each sensing line corresponding to the sensing pixels; and determining the electrical value of the non-sensing pixel located in at least one pixel column corresponding to one of the sensing lines, based on the estimated correlation corresponding to said one sensing line and deterioration information of the non-sensing pixel.

According to one or more exemplary embodiments, a display control apparatus for controlling a display operation of a display panel, which includes a plurality of pixels, includes: a deterioration information obtaining unit configured to accumulate image data values respectively input to the plurality of pixels to obtain deterioration information for each of the pixels; a sensing value obtaining unit configured to obtain an electrical value of each of a plurality of sensing pixels; an interpolation unit configured to determine an electrical value of a non-sensing pixel, based on the deterioration information of each of the plurality of pixels and an electrical value of each sensing pixel; and a compensation unit configured to control the display operation of the display panel, based on electrical values of the plurality of pixels, wherein the plurality of pixels include the plurality of sensing pixels, of which electrical values are sensed, and the non-sensing pixel, which is different from a sensing pixel.

According to one or more exemplary embodiments, a display apparatus includes: a display panel that includes a plurality of pixels, wherein the plurality of pixels includes a plurality of sensing pixels and a non-sensing pixel that is a pixel other than the plurality of sensing pixels; a sensing unit configured to sense an electrical value of each of the plurality of sensing pixels; and a display control unit configured to control a display operation of the display panel, based on the sensed electrical values, wherein the display control unit includes: a deterioration information obtaining unit configured to accumulate image data values respectively input to the plurality of pixels to obtain deterioration information for each of the plurality of pixels; a sensing value obtaining unit configured to obtain the electrical value of each of the plurality of sensing pixels from the sensing unit; an interpolation unit configured to determine an electrical value of the non-sensing pixel, based on the deterioration information of each of the plurality of pixels and the electrical value of each of the sensing pixels; and a compensation unit configured to control the display operation of the display panel, based on the electrical values of the plurality of sensing pixels and the electrical value of the non-sensing pixel.

In one embodiment, the interpolation unit is configured to determine the electrical value of the non-sensing pixel as an electrical value of one of the sensing pixels, wherein said one sensing pixel has the same deterioration information as the non-sensing pixel.

In one embodiment, the sensing unit is configured to sense the electrical value of each of the sensing pixels by utilizing a plurality of sensing lines which are in the display panel, and each of the plurality of sensing lines is in correspondence with at least one pixel column.

In one embodiment, the interpolation unit is configured to determine the electrical value of the non-sensing pixel, to be same as the electrical value of one of the sensing pixels, wherein said one sensing pixel has the same deterioration information as the non-sensing pixel, and said one sensing pixel is located in the same column as the non-sensing pixel.

In one embodiment, the sensing unit senses electrical values of a plurality of sensing pixels located in a first pixel column and a second pixel column adjacent to the first pixel column by utilizing the same sensing line, and the interpolation unit determines the electrical value of the non-sensing pixel located in the first pixel column or the second pixel column, to be same as the electrical value of one of the sensing pixels, wherein said one sensing pixel has the same deterioration information as the non-sensing pixel, and said one sensing pixel is located in the first pixel column or the second pixel column.

In one embodiment, a sensing pixel of the first pixel column and a sensing pixel of the second pixel column are on different pixel rows.

In one embodiment, each of the plurality of sensing lines is in correspondence with a plurality of pixel columns, and in a plurality of pixel columns corresponding to one of the plurality of sensing lines, only one sensing pixel is located in each pixel row.

In one embodiment, the interpolation unit is configured to estimate a correlation between the electrical values of the plurality of sensing pixels and deterioration information of the plurality of sensing pixels, and is configured to determine the electrical value of the non-sensing pixel, based on deterioration information of the non-sensing pixel and the estimated correlation.

In one embodiment, a plurality of sensing lines, which are in the display panel, is configured to sense the electrical values of the plurality of the sensing pixels, each of the plurality of sensing lines is in correspondence with at least one pixel column, and the interpolation unit is configured to estimate a correlation between the deterioration information of the sensing pixels and the electrical values of the sensing pixels, wherein the correlation corresponds to each sensing line, the display apparatus is configured to measure the electrical values of the sensing pixels by utilizing each sensing line corresponding to the sensing pixels, and to determine the electrical value of the non-sensing pixel located in at least one pixel column corresponding to one of the sensing lines, based on the estimated correlation corresponding to said one sensing line and deterioration information of the non-sensing pixel.

In addition to the aforesaid details, other aspects, features, and advantages will be clarified from the following drawings, claims, and detailed description.

These general and specific embodiments may be implemented by using a system, a method, a computer program, or a combination of the system, the method, and the computer program.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
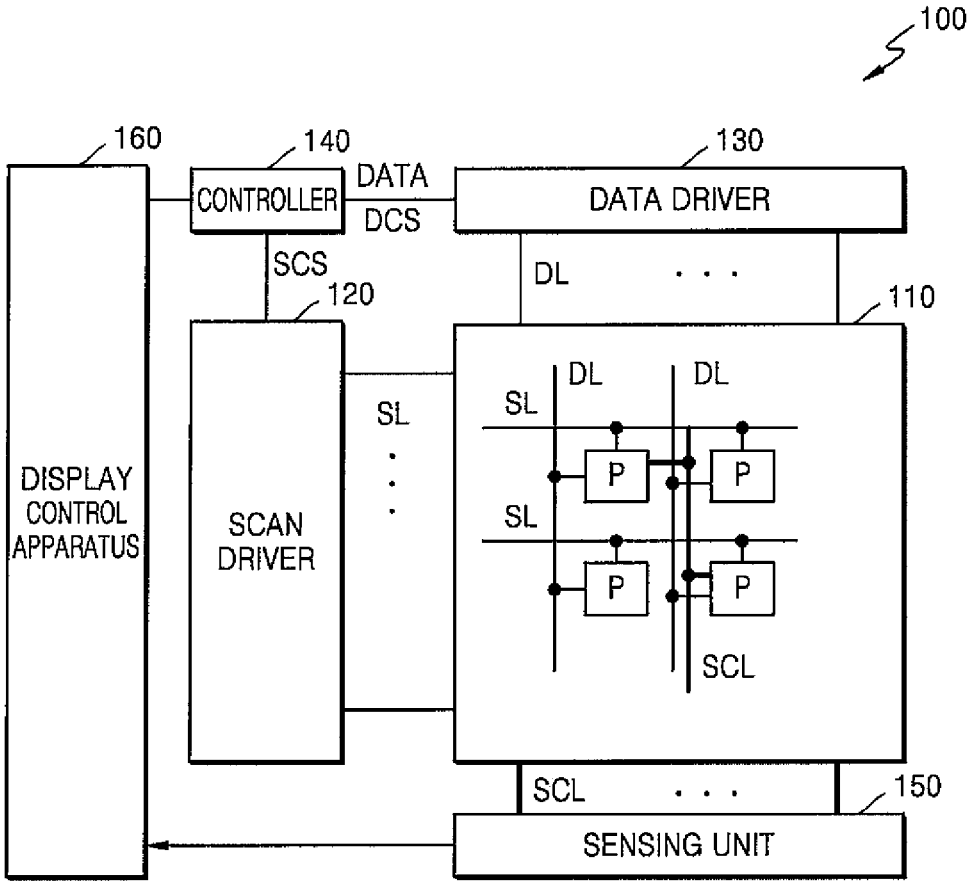
FIG. 1 illustrates a display apparatus according to an exemplary embodiment.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description.

Embodiments of the inventive concept may impose various transformations that may have various embodiments, and specific embodiments illustrated in the drawings will be described in detail in the detailed description. The effects and features of the inventive concept will become apparent from the following description of the embodiments with reference to the accompanying drawings, which is set forth hereinafter. The inventive concept may, however, may be embodied in different forms and should not be construed as being limited to the embodiments set forth herein.

Hereinafter, embodiments of the inventive concept will be described in detail with reference to the accompanying drawings. In addition, in the present specification and drawings, like reference numerals refer to like elements throughout, and thus, redundant descriptions are omitted.

In the following embodiments, the terms "first" and "second" are for differentiating one element from another element, and these elements should not be limited by these terms. In the following embodiments, the singular forms "a" and "an" are intended to include the plural forms as well, unless the context clearly indicates otherwise. In the following embodiments, it should be further understood that the terms "comprises", "comprising", "has", "having", "includes" and/or "including", when used herein, specify the presence of stated features, integers, steps, operations, elements, and/or components, but do not preclude the presence or addition of one or more other features, integers, steps, operations, elements, components, and/or groups thereof. In the drawings, the dimensions of layers and regions are exaggerated or reduced for clarity of illustration. For example, a dimension and thickness of each element in the drawings are arbitrarily illustrated for clarity, and thus, embodiments of the inventive concept are not limited thereto.

When a first element is described as being "coupled" or "connected" to a second element, the first element may be directly "coupled" or "connected" to the second element, or one or more other intervening elements may be located between the first element and the second element. Spatially relative terms, such as "beneath", "below", "lower", "downward", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. In contrast, when an element or layer is referred to as being "directly on," "directly connected to", "directly coupled to", or "immediately adjacent to" another element or layer, there are no intervening elements or layers present.

As used herein, the terms "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

The display and/or any other relevant devices or components according to embodiments of the present invention described herein may be implemented utilizing any suitable hardware, firmware (e.g. an application-specific integrated circuit), software, or a combination of software, firmware, and hardware. For example, the various components of the display may be formed on one integrated circuit (IC) chip or on separate IC chips. Further, the various components of the display may be implemented on a flexible printed circuit film, a tape carrier package (TCP), a printed circuit board (PCB), or formed on a same substrate. Further, the various components of the display may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

FIG. 1 illustrates a display apparatus 100 according to an exemplary embodiment.

Referring to FIG. 1, the display apparatus 100 according to an exemplary embodiment includes a display panel 110, a scan driver 120, a data driver 130, a controller 140, a sensing unit (or a sensor) 150, and a display control apparatus (or a display controller) 160.

The display panel 110 according to an exemplary embodiment includes a pixel P, a scan line SL, a data line DL, and a sensing line SCL. The display panel 110 may further include a plurality of power lines. The display panel 110 includes a plurality of pixels P that are arranged in a matrix type (or matrix configuration) along a column direction and a row direction. Each of a plurality of the data lines DL is connected to pixels P of the same column, and transfers a data signal to the pixels P of the same column. Each of a plurality of the scan lines SL is connected to pixels P of the same row, and transfers a scan signal to the pixels P of the same row.

The sensing line SCL may be provided in correspondence with at least one pixel column. For example, the sensing line SCL may be provided in correspondence with two pixel columns. When the total number of pixel columns is m number (i.e., when the total number of pixel columns is m), m/2 sensing lines SCL may be provided.

The sensing line SCL is connected to some of the pixels P of at least one column, and transfers an electrical value (e.g., sensed value) of each of the pixels P (to which it is connected) to the sensing unit 150. The pixels P may be divided into a plurality of sensing pixels, of which electrical values are directly sensed by the sensing line SCL, and a plurality of non-sensing pixels that are the other pixels. The sensing line SCL may transfer an electrical value of each of the plurality of sensing pixels to the sensing unit 150. Each of the pixels P may include a pixel circuit and a light-emitting device connected to the pixel circuit. A detailed configuration of each pixel P will be described below in detail with reference to FIG. 2.

The controller 140 receives image data from the display control apparatus 160, and controls the scan driver 120 and the data driver 130. The controller 140 generates a plurality of control signals SCS and DCS and data DATA. The controller 140 supplies a first control signal SCS to the scan driver 120, and supplies a second control signal DCS and data DATA to the data driver 130.

The scan driver 120 drives the scan lines SL (e.g., drives in a set or predetermined order) in response to the first control signal SCS. The scan driver 120 may generate the scan signal, and supply the scan signal to the pixels P through the scan lines SL.

The data driver 130 drives the data lines DL in response to the second control signal DCS and the data DATA. The data driver 130 may generate data signals respectively corresponding to the data lines DL, and supply the data signals to the pixels P through the data lines DL.

The sensing unit 150 may sense an electrical value for the display panel 110. In detail, the sensing unit 150 may sense an electrical value of each pixel P. The electrical value may be a current or a voltage. Hereinafter, a case where an electrical value is a current will be described as an example. The sensing unit 150 may sense a current flowing in each pixel P. The pixels P may be divided into a plurality of sensing pixels, of which electrical values are sensed by the sensing unit 150, and a plurality of non-sensing pixels that are the other pixels. The sensing unit 150 may sense a current of each of the plurality of sensing pixels. This will be described below in detail with reference to the other drawings.

The display control apparatus 160 controls an overall display operation of the display apparatus 100. According to an exemplary embodiment, the display control apparatus 160 compensates for a reduction (e.g., caused by deterioration of a pixel) in luminance, and to this end, a current value flowing in each pixel P for the same data signal may be adjusted. The display control apparatus 160 may acquire a current value of a sensing pixel from the sensing unit 150, and determine a current value of a non-sensing pixel, thereby acquiring a current value of all the pixels P. In order to determine a current value of a non-sensing pixel, the display control apparatus 160 may accumulate image data to generate deterioration information of each pixel, and determine the current value of the non-sensing pixel by using a current value of a sensing pixel and the deterioration information. This will be described below in detail with reference to FIG. 6.

Figure 2:
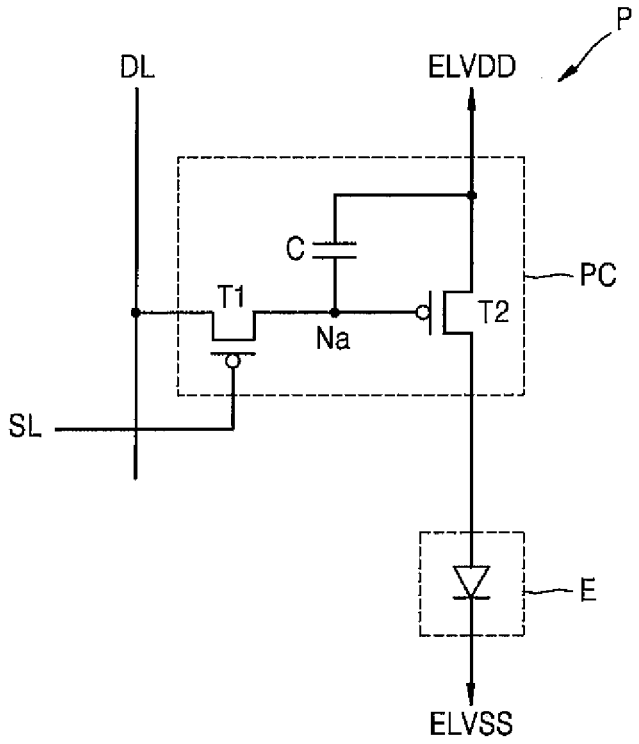
FIG. 2 illustrates an exemplary pixel configuration of a pixel according to an exemplary embodiment.

FIG. 2 illustrates an exemplary pixel configuration of a pixel P according to an exemplary embodiment.

Referring to FIG. 2, the pixel P includes a light-emitting device E, which emits light, and a pixel circuit PC that supplies a current to the light-emitting device E. The light-emitting device E may be an organic light-emitting diode (OLED) that includes a first electrode, a second electrode opposite to the first electrode, and an emission layer between the first electrode and the second electrode, but is not limited thereto. The first electrode may be an anode electrode, and the second electrode may be a cathode electrode. The pixel circuit PC may include two transistors T1 and T2 and one capacitor C.

The first transistor T1 includes a gate electrode connected to a scan line SL, a first electrode connected to a data line DL, and a second electrode connected to a first node Na.

A second transistor T2 includes a gate electrode connected to the first node Na, a first electrode for receiving a first source voltage ELVDD, and a second electrode connected to one electrode of the light-emitting device E.

The capacitor C includes a first electrode connected to the first node Na and a second electrode for receiving the first source voltage ELVDD.

When a scan signal is supplied from the scan line SL, the first transistor T1 transfers a data signal, supplied from the data line DL, to the first electrode of the capacitor C. Therefore, a voltage corresponding to the data signal is charged into the capacitor C, and a driving current corresponding to the voltage charged into the capacitor C is transferred to the light-emitting device E through the second transistor T2, thereby emitting light from the light-emitting device E. The sensing unit 150 according to an exemplary embodiment senses a current, flowing in the light-emitting device E, in the pixel P illustrated in FIG. 2.

In FIG. 2, a 2Tr-1 Cap structure in which the two transistors T1 and T2 and the one capacitor C are included in the one pixel P is illustrated, but a structure of the pixel P according to an exemplary embodiment is not limited thereto. Therefore, two or more thin film transistors (TFTs) and one or more capacitors may be included in the one pixel P. Also, a separate line may be further formed, or the existing line may be omitted, whereby the one pixel P may be formed to have various structures.

The light-emitting device E (for example, an OLED) of FIG. 2 may deteriorate as a driving time is accumulated. When the OLED deteriorates, efficiency is reduced, and for this reason, even though a data voltage having the same level is applied, light having lower luminance is emitted, whereby a desired image is not displayed.

A current, which is measured by applying a voltage having a certain level to a deteriorated OLED, is lower than a current which is measured by applying a voltage, having the same level as that of the voltage, to a non-deteriorated pixel. In other words, when a certain voltage is applied to an OLED that has deteriorated, the resulting current may be less than the current that results when the same voltage is applied to an OLED that has not deteriorated. This may be understood as a phenomenon which occurs because an OLED is deteriorated, and thus, an internal resistance has increased.

Figure 3:
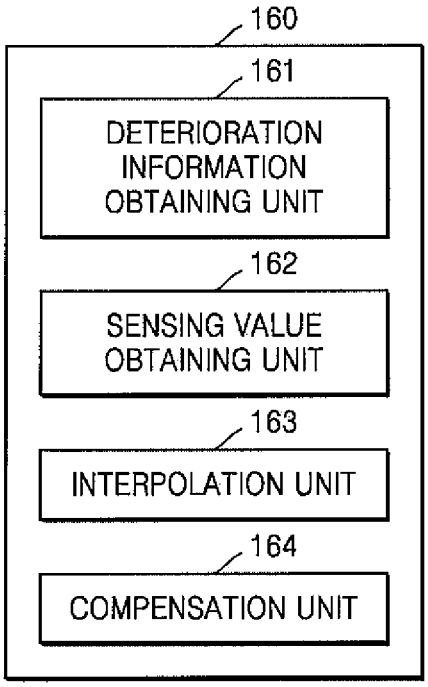
FIG. 3 is a block diagram illustrating a configuration of a display control apparatus according to an exemplary embodiment.

FIG. 3 is a block diagram illustrating a configuration of the display control apparatus 160 according to an exemplary embodiment.

In the display control apparatus 160 illustrated in FIG. 3, only elements according to an exemplary embodiment are illustrated for preventing a feature of the present embodiment from being obscured. Therefore, it may be understood by one of ordinary skill in the art that in addition to elements illustrated in FIG. 3, other general-use elements may be further included.

The display control apparatus 160 according to an exemplary embodiment may correspond to at least one or more processors, or include at least one or more processors. Therefore, the display control apparatus 160 may be driven in a type which is included in (e.g., the display control apparatus 160 may be implemented in) a hardware apparatus such as a micro-processor or a general-use computer system.

The display control apparatus 160 according to an exemplary embodiment obtains an electrical value of a sensing pixel from the sensing unit 150, accumulates image data to generate deterioration information of all pixels, and obtains an electrical value of a non-sensing pixel with reference to the electrical value of the sensing pixel and the deterioration information of all the pixels. Therefore, the display control apparatus 160 may obtain electrical values of all the pixels, and control a display operation of the display panel 110, based on the obtained electrical values. For example, in order to solve non-uniform luminance caused by different degrees of deterioration of the pixels of the display panel 110, a luminance of image data applied to each pixel may be compensated for.

Referring to FIG. 3, the display control apparatus 160 according to an exemplary embodiment includes a deterioration information obtaining unit 161, a sensing value obtaining unit 162, an interpolation unit 163, and a compensation unit 164.

The deterioration information obtaining unit 161 accumulates image data values respectively input to a plurality of pixels to obtain deterioration information of each pixel. It may be predicted that as a gray level of image data becomes higher, a pixel deteriorates more rapidly. Therefore, as an accumulated image data value of a pixel becomes greater, the deterioration information obtaining unit 161 may recognize a light-emitting device of the pixel as being more deteriorated.

The sensing value obtaining unit 162 obtains an electrical value of each of a plurality of sensing pixels. For example, a current value flowing in a light-emitting device of each sensing pixel may be obtained. When the same data signal is input to all the sensing pixels, the sensing value obtaining unit 162 may obtain the electrical value of each sensing pixel. Therefore, when the same data signal is input, a difference between electrical values of respective pixels may be known, and the compensation unit 164 may compensate for luminance, based on the difference.

The interpolation unit 163 determines an electrical value of the non-sensing pixel, based on deterioration information and the electrical value of each of the sensing pixels. The electrical values obtained by the sensing value obtaining unit 162 are for some pixels (i.e., the sensing pixels) of the display panel 110, and thus, the interpolation unit 163 determines electrical values of the other pixels (i.e., the non-sensing pixels) to obtain electrical values of all the pixels. That is, the interpolation unit 163 analogizes non-sensed values by using the sensed values, and thus, it may be considered that the interpolation unit 163 performs interpolation on an electrical value of the pixel P (e.g., the interpolation unit 163 performs interpolation to determine an electrical value of a pixel P) of the display panel 110.

According to an exemplary embodiment, the interpolation unit 163 may determine an electrical value of a sensing pixel, having the same deterioration information as that of a non-sensing pixel, as an electrical value of the non-sensing pixel. The interpolation unit 163 may determine an electrical value of a sensing pixel, having the same accumulation deterioration information as that of a non-sensing pixel among a plurality of sensing pixels included in the same column as the non-sensing pixel, as an electrical value of the non-sensing pixel. That is, electrical values of sensing pixels included in the same column as a non-sensing pixel may be used in performing an interpolation operation to determine an electrical value of the non-sensing pixel. Since a characteristic difference such as an offset occurs between different sensing lines, interpolation may be performed between pixels corresponding to one sensing line, and thus may be performed without using (e.g., the interpolation may be unaffected by) a characteristic difference between sensing lines.

As described above, a sensing line may correspond to a plurality of columns, and electrical values of sensing pixels included in the plurality of columns may be measured. In this case, for example, interpolation may be performed between pixels (hereinafter, a first pixel group) included in a plurality of columns corresponding to a first sensing line. That is, an electrical value of a non-sensing pixel included in the first pixel group may be determined from an electrical value of a sensing pixel included in the first pixel group. In detail, the electrical value of the non-sensing pixel included in the first pixel group may be determined identically to an electrical value of a sensing pixel having the same degree of deterioration as the non-sensing pixel among a plurality of sensing pixels included in the first pixel group.

For example, when electrical values of a plurality of sensing pixels included in a first pixel column and a second pixel column adjacent to the first pixel column are sensed by the same sensing line, the interpolation unit 163 may use the electrical values of the sensing pixels included in the first pixel column and the second pixel column, for determining electrical values of a plurality of non-sensing pixels included in the first pixel column and the second pixel column. In detail, an electrical value of a non-sensing pixel of the first pixel column or the second pixel column may be determined identically to (e.g., the electrical value may be determined to be identical to that of) an electrical value of a sensing pixel having the same degree of deterioration as the non-sensing pixel among a plurality of sensing pixels included in the first pixel column or the second pixel column.

According to an exemplary embodiment, the interpolation unit 163 may estimate a correlation between an electrical value and deterioration information of a sensing pixel by using the electrical value and deterioration information of the sensing pixel. Also, the interpolation unit 163 may determine an electrical value of a non-sensing pixel, based on the estimated correlation and deterioration information of the non-sensing pixel. In detail, the interpolation unit 163 may determine an electrical value, corresponding to the deterioration information of the non-sensing pixel in the estimated correlation, as the electrical value of the non-sensing pixel.

According to an exemplary embodiment, in estimating a correlation, the interpolation unit 163 may estimate the correlation by using electrical values sensed by the same sensing line. That is, the interpolation unit 163 may estimate a correlation between deterioration information and an electrical value of a sensing pixel which are measured by using one sensing line, for each sensing line. As described above, the estimated correlation may be generated for each sensing line, and if interpolation is performed by using the correlation, accurate interpolation may be performed without using (e.g., unaffected by) a characteristic difference between sensing lines. The interpolation unit 163 may determine electrical values of non-sensing pixels included in a pixel column corresponding to a corresponding sensing line by using a correlation which is estimated in correspondence with each sensing line.

The compensation unit 164 controls a display operation of the display panel 110, based on electrical values of a plurality pixels for which interpolation has been performed by the interpolation unit 163. For example, the compensation unit 164 compensates for a luminance of an image displayed by the display panel 110. A difference between the electrical values denotes a difference between degrees of deterioration of pixels. Therefore, the compensation unit 164 may compensate for a data signal applied to each pixel by a deviation of degrees of deterioration of pixels by using the electrical values, and thus, each pixel emits light having uniform luminance. For example, the compensation unit 164 may adjust the data signal applied to each pixel to compensate for the relative degree of deterioration of the pixel.

Hereinafter, exemplary embodiments will be described in detail with reference to FIGS. 4 to 6 in reference to components of the display control apparatus 160 of FIG. 3.

Figure 4:
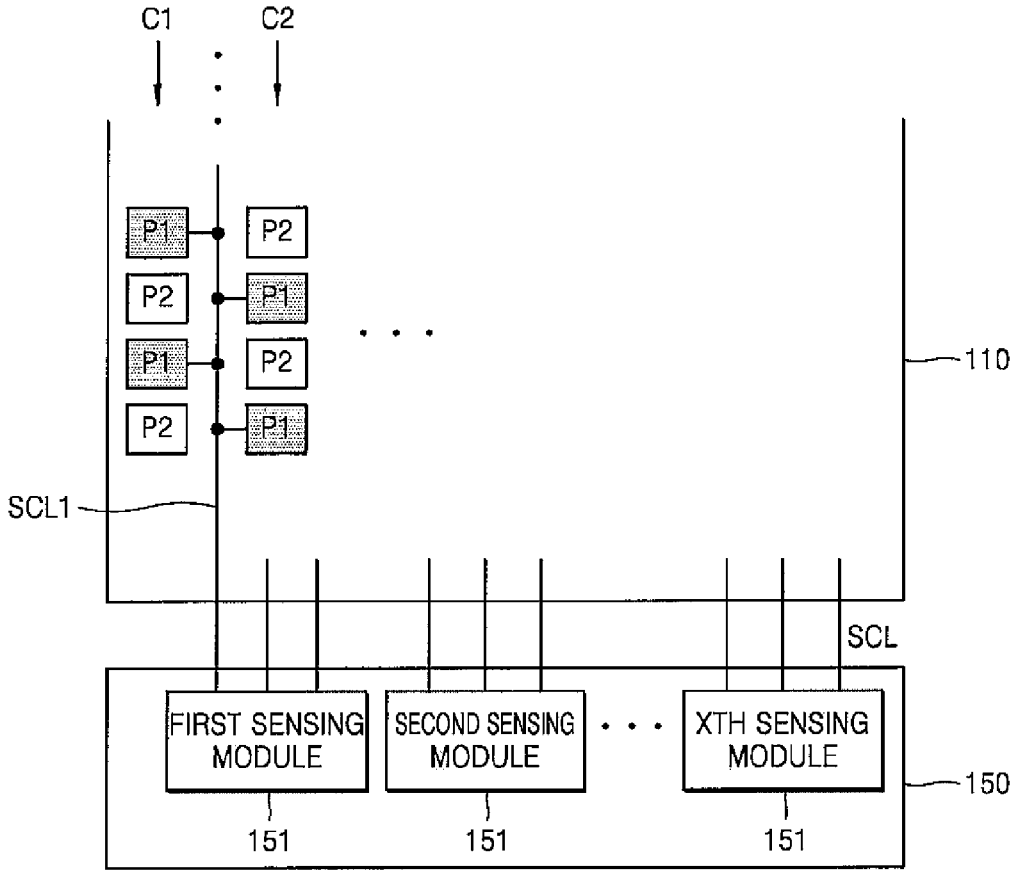
FIG. 4 illustrates a portion of a connection structure of a sensing line and a pixel according to an exemplary embodiment.

FIG. 4 illustrates a portion of a connection structure of a sensing line and a pixel according to an exemplary embodiment. FIG. 4 illustrates a detailed configuration of the sensing unit 150, a portion of the display panel 110, and a portion of the pixels P.

Referring to FIG. 4, the sensing unit 150 may include a plurality of sensing modules 151. Each of the sensing modules 151 may sense an electrical value from the display panel 110 through a plurality of channels. A sensing line SCL may be connected to each of the channels. Therefore, a plurality of sensing lines SCL may be connected to each of the sensing modules 151.

The sensing line SCL senses an electrical value from the pixels P of the display panel 110. The pixels P are divided into (e.g., include) a sensing pixel P1, connected to the sensing line SCL, and a non-sensing pixel P2. A pixel column corresponding to one sensing line SCL1 is illustrated in FIG. 4, and some of pixels of a first pixel column C1 and a second pixel column C2 are illustrated in FIG. 3. In the drawings, pixels connected to the other sensing lines SCL are not illustrated. However, in this way, a sensing pixel P1 may be connected to each of the other sensing lines SCL.

To provide a description with reference to a first sensing line SCL1 of a plurality of sensing lines SCL illustrated in FIG. 4, the first sensing line SCL1 may be connected to a plurality of sensing pixels P1 and may sense an electrical value from each of the sensing pixels P1. The first sensing line SCL1 may correspond to a first pixel column C1 and a second pixel column C2 adjacent thereto. The first sensing line SCL1 may sense an electrical value from a sensing pixel P included in the first pixel column C1 and the second pixel column C2. For example, the first sensing line SCL1 may sense an electrical value from a sensing pixel P1 included in the first pixel column C1, and it may also sense an electrical value from a sensing pixel P1 included in the second pixel column C2.

As illustrated in FIG. 4, the sensing line SCL may be formed in a pixel column direction, and may obtain an electrical value from a sensing pixel P1 of a corresponding pixel row according to a timing when the scan signal is applied to the scan lines. Therefore, one sensing line SCL may obtain an electrical value of one sensing pixel for each pixel row. Referring to FIG. 4, the first sensing line SCL1 may obtain an electrical value of a sensing pixel P1 connected to the first sensing line SCL1 in order where the scan signal is applied, for example, in sequence from a top of the display panel 110. For example, the scan signal may be applied to one scan line at a time, in sequence from a top of the display panel 110, and the sensing line SCL may obtain a value for a sensing pixel in a pixel row when the scan signal is applied to that pixel row.

As described above, when the scan signal is input to a pixel row, a maximum of one sensing pixel P1 among a plurality of pixels of a pixel column corresponding to one sensing line SCL1 may be included in each pixel row so as to sense an electrical value of one sensing pixel P1 at a corresponding timing.

For example, the first sensing line SCL1 may be alternately connected to a sensing pixel P1 of the first pixel column C1 and a sensing pixel P1 of the second pixel column C2. The sensing pixel P1 of the first pixel column C1 and the sensing pixel P1 of the second pixel column C2 may be disposed on different rows. Also, a sensing pixel P1 and a non-sensing pixel P2 may be disposed adjacent to each other in the display panel 110. As another example, all pixels of the first pixel column C1 may be a plurality of sensing pixels P1, and all pixels of the second pixel column C2 may be a plurality of non-sensing pixels P2.

The interpolation unit 163 of FIG. 3 may determine electrical values of non-sensing pixels P2 of the first pixel column C1 and the second pixel column C2, based on electrical values of sensing pixels P1 of the first pixel column C1 and the second pixel column C2 illustrated in FIG. 4.

Figure 5:
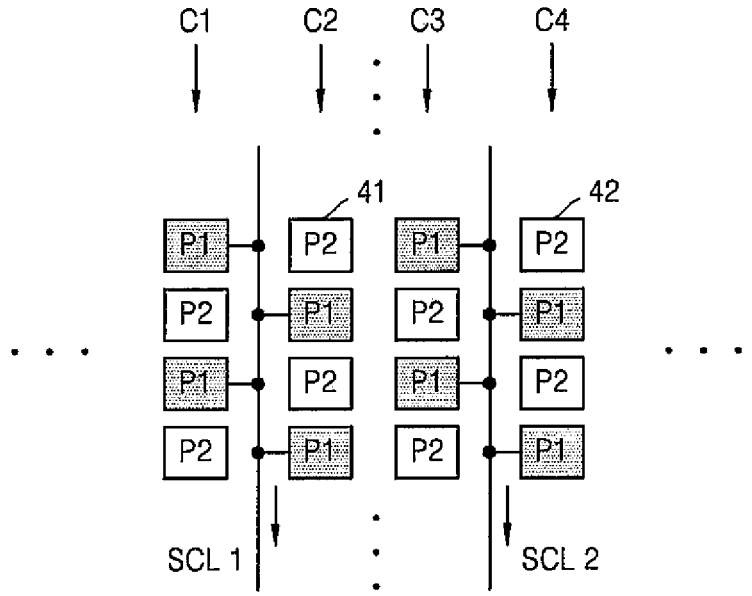
FIG. 5 illustrates a plurality of sensing lines and a portion of a plurality of pixels connected to each of the plurality of sensing lines.

FIG. 5 illustrates a plurality of sensing lines and a portion of a plurality of pixels connected to each of the plurality of sensing lines.

Referring to FIG. 5, two adjacent sensing lines are illustrated. In detail, a first sensing line SCL1 and a second sensing line SCL2 are illustrated. Also, some pixels connected to each sensing line are illustrated.

Referring to FIG. 5, it may be seen that the first sensing line SCL1 corresponds to the first pixel column C1 and the second pixel column C2, and the second sensing line SCL2 corresponds to a third pixel column C3 and a fourth pixel column C4.

In determining an electrical value of a non-sensing pixel, the interpolation unit 163 according to an exemplary embodiment may refer to electrical values of sensing pixels of the same pixel column or electrical values of sensing pixels of the other pixel column connected to the same sensing line as the same pixel column. In an example of FIG. 5, electrical values of sensing pixels P1 of the first pixel column C1 and the second pixel column C2 may be referred to for determining an electrical value of a non-sensing pixel 41, and electrical values of sensing pixels P1 of the third pixel column C3 and the fourth pixel column C4 may be referred to for determining an electrical value of a non-sensing pixel 42.

The reason that interpolation is performed as described above is that an electrical deviation (or variation) may exist in each sensing line. Such an example is illustrated in FIG. 6. To this end, the interpolation unit 163 may estimate a correlation between an electrical value of a sensing pixel P1 and deterioration information of the sensing pixel P1 obtained by the deterioration information obtaining unit 161, for each sensing line SCL.

Figure 6:
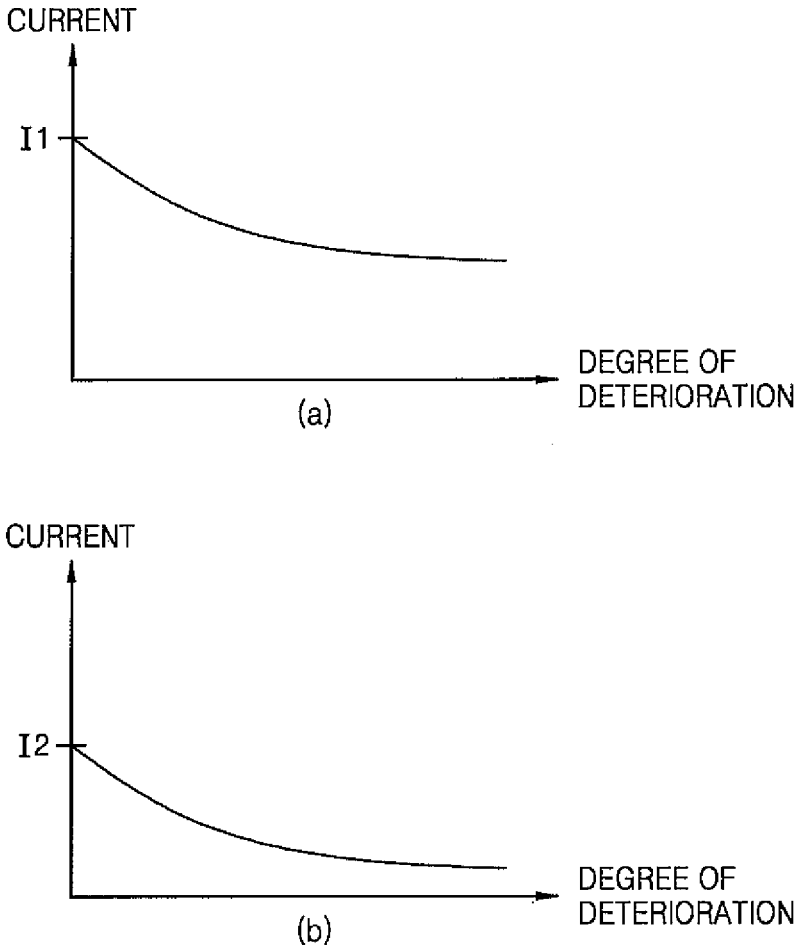
FIG. 6 shows an example of an estimated correlation for each of the sensing lines of FIG. 4.

FIG. 6 shows an example of an estimated correlation for each of the sensing lines of FIG. 4.

FIG. 6(*a*) shows a correlation between electrical values and degrees of deterioration of sensing pixels connected to the first sensing line SCL1, and FIG. 6(*b*) shows a correlation between electrical values and degrees of deterioration of sensing pixels connected to the second sensing line SCL2 (FIG. 5).

Referring to FIG. 6, it may be seen that an offset exists between correlations estimated for sensing lines. In an example of FIG. 6, when a degree of deterioration is 0, a current I1 is measured in the first sensing line SCL1, and a current I2 is measured in the second sensing line SCL2. That is, an offset deviation equal to "I1−I2" exists between two sensing lines.

Therefore, if an electrical value of the non-sensing pixel P1 of the first sensing line SCL1 were to be determined based on an electrical value of the sensing pixel P1 of the second sensing line SCL2, an inaccurate result would be obtained. Furthermore, if electrical values of all the pixels are obtained, an offset deviation between sensing lines is removed by a separate compensation operation subsequent thereto.

Figure 7:
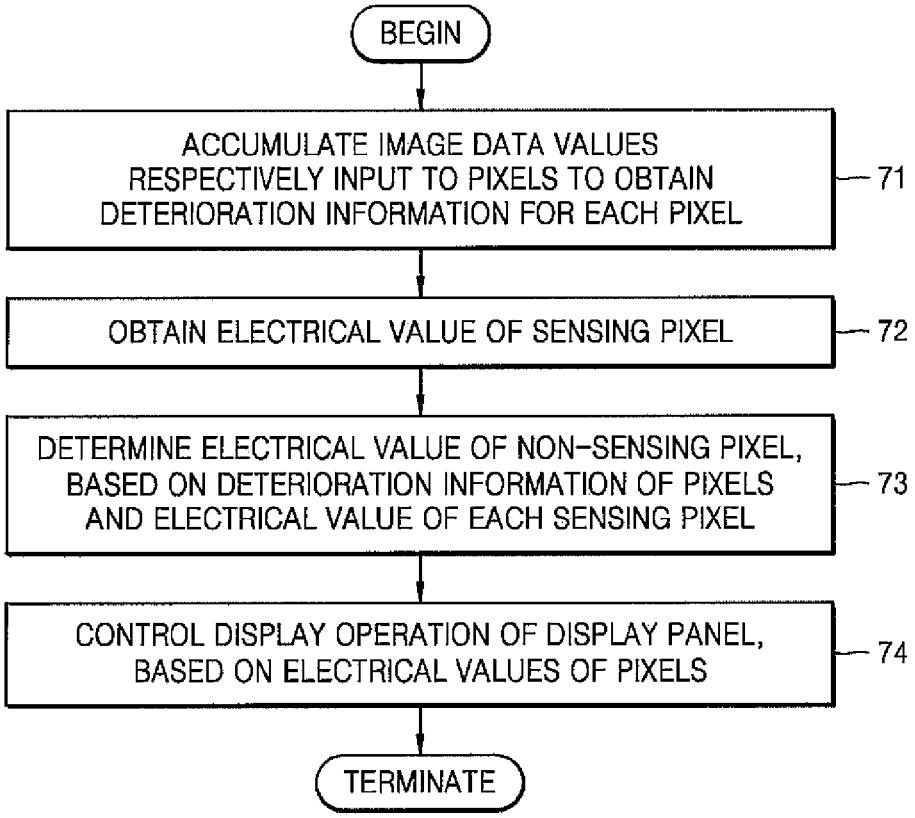
FIG. 7 is a flowchart of a display control method according to an exemplary embodiment.

FIG. 7 is a flowchart of a display control method according to an exemplary embodiment.

The flowchart of FIG. 7 is configured with operations which are time-serially performed by the display control apparatus 160 of FIG. 3. Therefore, it may be seen that despite details which are omitted below, details described above for the elements illustrated in FIG. 3 are applied to the flowchart of FIG. 7. Hereinafter, FIG. 7 will be described with reference to the elements of FIG. 3.

Referring to FIG. 7, in operation 71, the deterioration information obtaining unit 161 of FIG. 3 accumulates image data values respectively input to the plurality of pixels to obtain deterioration information for each pixel.

In operation 72, the sensing value obtaining unit 162 of FIG. 3 obtains an electrical value of a sensing pixel. The electrical value of the sensing pixel may be measured by the sensing unit 150.

In operation 73, the interpolation unit 163 of FIG. 3 determines an electrical value of a non-sensing pixel, based on the deterioration information which is obtained in operation 71 and the electrical value of each sensing pixel which is obtained in operation 72. Therefore, the interpolation unit 163 of FIG. 3 obtains electrical values of all the pixels of the display panel 110.

In operation 74, the compensation unit 164 of FIG. 3 controls a display operation of the display panel 110, based on the electrical values of the plurality of pixels.

According to the above-described exemplary embodiments, since electrical values of pixels of a plurality of columns are sensed by using one sensing line, an aperture ratio is more enhanced than a case in which a sensing line is formed for each of all pixel columns (e.g., the aperture ratio of the display panel 110 may be higher than it would be if a sensing line were formed for each of the pixel columns).

Moreover, according to the above-described exemplary embodiments, electrical values of all pixels are interpolated at high accuracy even without directly sensing the electrical values of all the pixels by using a sensing line.

As described above, according to the one or more of the above exemplary embodiments, an accurate electrical value is acquired in spite of using a low-specification sensing module in sensing an electrical value of a display panel.

Moreover, a compensation amount corresponding to a reduction (caused by deterioration of a pixel) in luminance is determined based on an accurate electrical value, and thus, electrical characteristic is enhanced.

It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims, and equivalents thereof.

What is claimed is:

1. A display control method of controlling a display operation of a display panel that includes a plurality of pixels arranged in a column direction and a row direction, the display control method comprising:

accumulating image data values respectively input to the plurality of pixels to obtain deterioration information for each of the plurality of pixels;

obtaining an electrical value of each of a plurality of sensing pixels;

determining an electrical value of a non-sensing pixel based on the deterioration information of each of the plurality of pixels and based on the electrical value of each of the plurality of sensing pixels; and controlling the display operation of the display panel based on electrical values of the plurality of pixels, wherein the plurality of pixels comprises the plurality of sensing pixels, of which electrical values are sensed, and the non-sensing pixel, which is different from a sensing pixel, and wherein the sensing pixels and the non-sensing pixel are configured to emit light.

2. The display control method of claim 1, wherein the determining comprises determining the electrical value of the non-sensing pixel as an electrical value of one of the sensing pixels having the same deterioration information as the non-sensing pixel.

3. The display control method of claim 1, wherein the electrical value of each of the sensing pixels is sensed via a corresponding one of a plurality of sensing lines that are in the display panel, and wherein each of the plurality of sensing lines is in correspondence with at least one pixel column.

4. The display control method of claim 3, wherein the determining comprises determining the electrical value of the non-sensing pixel to be same as the electrical value of one of the sensing pixels, wherein said one of the sensing pixels has the same deterioration information as the non-sensing pixel, and wherein said one of the sensing pixels is located in the same column as the non-sensing pixel.

5. The display control method of claim 3, wherein electrical values of a plurality of sensing pixels located in a first pixel column and a second pixel column adjacent to the first pixel column are sensed via the same sensing line, wherein the determining comprises determining the electrical value of the non-sensing pixel located in the first pixel column or the second pixel column to be the same as the electrical value of one of the sensing pixels having the same deterioration information as the non-sensing pixel and being located in the first pixel column or the second pixel column.

6. The display control method of claim 5, wherein a sensing pixel of the first pixel column and a sensing pixel of the second pixel column are in different pixel rows.

7. The display control method of claim 3, wherein each of the plurality of sensing lines is in correspondence with a plurality of pixel columns, and wherein, in a plurality of pixel columns corresponding to one of the plurality of sensing lines, only one sensing pixel is located in each pixel row.

8. The display control method of claim 1, wherein the determining comprises:

estimating a correlation between the electrical values of the plurality of sensing pixels and deterioration information of the plurality of sensing pixels; and determining the electrical value of the non-sensing pixel based on deterioration information of the non-sensing pixel and the estimated correlation.

9. The display control method of claim 8, wherein the electrical values of the plurality of sensing pixels are sensed by a plurality of sensing lines that are in the display panel, wherein each of the plurality of sensing lines is in correspondence with at least one pixel column, and wherein the determining comprises:

estimating a correlation between the deterioration information of the sensing pixels and the electrical values of the sensing pixels, wherein the correlation corresponds to each of the sensing lines, the electrical values of the sensing pixels being measured by utilizing each sensing line corresponding to the sensing pixels; and determining the electrical value of the non-sensing pixel located in at least one pixel column corresponding to one of the sensing lines based on the estimated correlation corresponding to said one of the sensing lines and deterioration information of the non-sensing pixel.

10. A display controller for controlling a display operation of a display panel that includes a plurality of pixels, the display controller comprising:

a deterioration information obtaining unit configured to accumulate image data values respectively input to the plurality of pixels to obtain deterioration information for each of the pixels;

a sensing value obtaining unit configured to obtain an electrical value of each of a plurality of sensing pixels;

an interpolation unit configured to determine an electrical value of a non-sensing pixel based on the deterioration information of each of the plurality of pixels and an electrical value of each sensing pixel; and a compensation unit configured to control the display operation of the display panel based on electrical values of the plurality of pixels, wherein the plurality of pixels comprises the plurality of sensing pixels, of which electrical values are sensed, and the non-sensing pixel, which is different from a sensing pixel, and wherein the sensing pixels and the non-sensing pixel are configured to emit light.

11. A display apparatus comprising:

a display panel that includes a plurality of pixels, wherein the plurality of pixels includes a plurality of sensing pixels and a non-sensing pixel that is a pixel other than the plurality of sensing pixels;

a sensing unit configured to sense an electrical value of each of the plurality of sensing pixels; and a display control unit configured to control a display operation of the display panel based on the sensed electrical values, wherein the display control unit comprises:

a deterioration information obtaining unit configured to accumulate image data values respectively input to the plurality of pixels to obtain deterioration information for each of the plurality of pixels;

a sensing value obtaining unit configured to obtain the electrical value of each of the plurality of sensing pixels from the sensing unit;

an interpolation unit configured to determine an electrical value of the non-sensing pixel based on the deterioration information of each of the plurality of pixels and the electrical value of each of the sensing pixels; and a compensation unit configured to control the display operation of the display panel based on the electrical values of the plurality of sensing pixels and the electrical value of the non-sensing pixel, and wherein the sensing pixels and the non-sensing pixel are configured to emit light.

12. The display apparatus of claim 11, wherein the interpolation unit is configured to determine the electrical value of the non-sensing pixel as an electrical value of one of the sensing pixels having the same deterioration information as the non-sensing pixel.

13. The display apparatus of claim 11, wherein the sensing unit is configured to sense the electrical value of each of the sensing pixels by utilizing a plurality of sensing lines that are in the display panel, and wherein each of the plurality of sensing lines is in correspondence with at least one pixel column.

14. The display apparatus of claim 13, wherein the interpolation unit is configured to determine the electrical value of the non-sensing pixel to be same as the electrical value of one of the sensing pixels having the same deterioration information as the non-sensing pixel and being located in the same column as the non-sensing pixel.

15. The display apparatus of claim 13, wherein the sensing unit is configured to sense electrical values of a plurality of sensing pixels located in a first pixel column and a second pixel column adjacent to the first pixel column by utilizing the same sensing line, and wherein the interpolation unit is configured to determine the electrical value of the non-sensing pixel located in the first pixel column or the second pixel column to be same as the electrical value of one of the sensing pixels having the same deterioration information as the non-sensing pixel and being located in the first pixel column or the second pixel column.

16. The display apparatus of claim 15, wherein a sensing pixel of the first pixel column and a sensing pixel of the second pixel column are on different pixel rows.

17. The display apparatus of claim 13, wherein each of the plurality of sensing lines is in correspondence with one of a plurality of pixel columns, and wherein, in a plurality of pixel columns corresponding to one of the plurality of sensing lines, only one sensing pixel is located in each pixel row.

18. The display apparatus of claim 11, wherein the interpolation unit is configured to estimate a correlation between the electrical values of the plurality of sensing pixels and deterioration information of the plurality of sensing pixels, and is configured to determine the electrical value of the non-sensing pixel based on deterioration information of the non-sensing pixel and the estimated correlation.

19. The display apparatus of claim 18, wherein a plurality of sensing lines, which are in the display panel, is configured to sense the electrical values of the plurality of the sensing pixels, wherein each of the plurality of sensing lines is in correspondence with at least one pixel column, and wherein the interpolation unit is configured to estimate a correlation between the deterioration information of the sensing pixels and the electrical values of the sensing pixels, the correlation corresponding to each sensing line, wherein the display apparatus is configured to measure the electrical values of the sensing pixels by utilizing each sensing line corresponding to the sensing pixels, and to determine the electrical value of the non-sensing pixel located in at least one pixel column corresponding to one of the sensing lines, based on the estimated correlation corresponding to said one of the sensing lines and deterioration information of the non-sensing pixel.

* * * * *